US008518163B2

(12) United States Patent
Lemont et al.

(10) Patent No.: US 8,518,163 B2
(45) Date of Patent: Aug. 27, 2013

(54) ELECTROSTATIC FILTERING DEVICE USING OPTIMIZED EMISSIVE SITES

(75) Inventors: Florent Lemont, Villeneuve les Avignon (FR); Antoine Silvestre de Ferron, Gan (FR); Thierry Reess, Mazerolles (FR); Aldo Russello, Tavel (FR)

(73) Assignees: Commissariat a l'Energie Atomique et aux Energies Alternatives, Paris (FR); Universite de Pau et Des Pays de L'Adour, Pau Cedex (FR)

( * ) Notice: Subject to any disclaimer, the term of this patent is extended or adjusted under 35 U.S.C. 154(b) by 427 days.

(21) Appl. No.: 12/867,477

(22) PCT Filed: Feb. 17, 2009

(86) PCT No.: PCT/EP2009/051863

§ 371 (c)(1), (2), (4) Date: Oct. 6, 2010

(87) PCT Pub. No.: WO2009/103704

PCT Pub. Date: Aug. 27, 2009

(65) Prior Publication Data

US 2011/0017067 A1 Jan. 27, 2011

(30) Foreign Application Priority Data

Feb. 19, 2008 (FR) ..... 08 51037

(51) Int. Cl.
*B03C 3/66* (2006.01)

(52) U.S. Cl.
USPC ..... 96/80; 95/81; 96/88; 96/97

(58) Field of Classification Search
USPC ..... 96/80, 88, 97; 95/80, 81; 55/DIG. 1; 210/243, 748.01, 748.05; 323/903; 361/225–235
See application file for complete search history.

(56) References Cited

U.S. PATENT DOCUMENTS

| | | | | | |
|---|---|---|---|---|---|
| 1,934,923 | A | * | 11/1933 | Heinrich | 95/81 |
| 2,997,642 | A | * | 8/1961 | Brooks | 96/19 |
| 3,984,215 | A | * | 10/1976 | Zucker | 95/81 |
| 4,265,641 | A | | 5/1981 | Natarajan | |
| 4,613,346 | A | | 9/1986 | Reyes et al. | |

(Continued)

FOREIGN PATENT DOCUMENTS

| | | | |
|---|---|---|---|
| DE | 3327443 | A1 | 2/1984 |
| DE | 102006009765 | A1 | 9/2007 |

(Continued)

OTHER PUBLICATIONS

Translation of International Preliminary Report on Patentability in International Application No. PCT/EP2009/051863, mailed Jan. 20, 2011.

(Continued)

*Primary Examiner* — Richard L Chiesa
(74) *Attorney, Agent, or Firm* — Nixon Peabody LLP

(57) ABSTRACT

A device having advantages in terms of equipment maintenance, since it provides maximum limitation of the onset of electric arcing between the electrodes, including a vertical cathode equipped with emissive points, these points being offset at an angle from each other from one plane to another, so as to be optimally distributed in space. One embodiment using two planar anodes, between which several vertical cathodes are arranged equipped with points, is also envisaged.

10 Claims, 4 Drawing Sheets

(56) References Cited

U.S. PATENT DOCUMENTS

Figure 1:
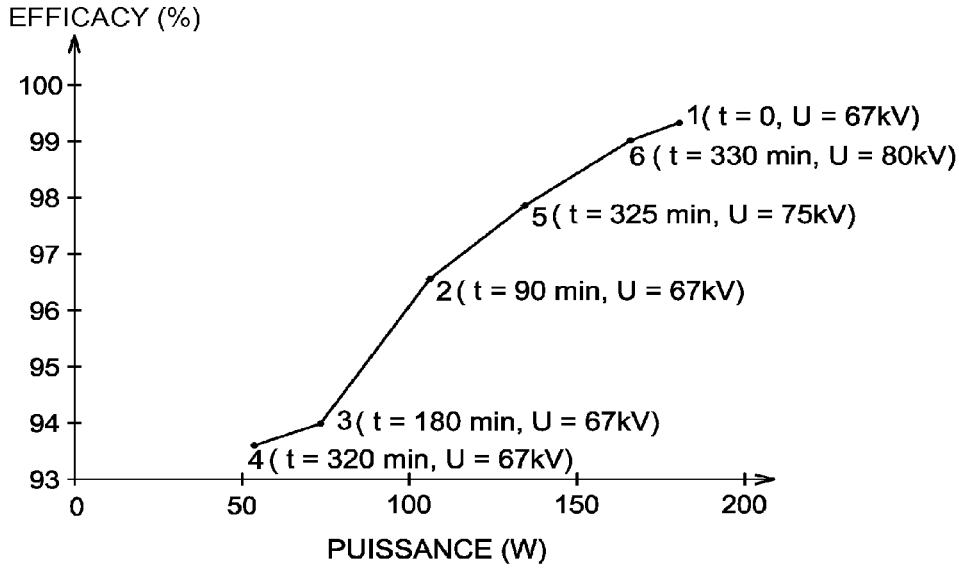
FIG. 1 PRIOR ART

| | | | | |
|---|---|---|---|---|
| 4,772,998 | A * | 9/1988 | Guenther et al. | 363/128 |
| 5,575,836 | A * | 11/1996 | Sugiura et al. | 96/82 |
| 5,707,422 | A * | 1/1998 | Jacobsson et al. | 95/6 |
| 6,611,440 | B1 * | 8/2003 | Johnston et al. | 363/44 |
| 7,122,070 | B1 * | 10/2006 | Krichtafovitch | 95/2 |
| 7,285,155 | B2 * | 10/2007 | Taylor et al. | 96/25 |
| 2004/0004440 | A1 | 1/2004 | Krichtafovitch et al. | |
| 2007/0151448 | A1 | 7/2007 | Taylor et al. | |
| 2007/0234905 | A1 | 10/2007 | Bromberg | |
| 2008/0307974 | A1 * | 12/2008 | Johnston et al. | 96/80 |

FOREIGN PATENT DOCUMENTS

| | | | |
|---|---|---|---|
| DE | 102007020504 | A1 | 11/2007 |
| EP | 1652586 | A1 | 5/2006 |
| GB | 2068659 | A | 8/1981 |
| JP | 4-300662 | A * | 10/1992 |
| JP | 2001198488 | A | 7/2001 |
| WO | 2007102191 | A1 | 9/2007 |
| WO | 2007135860 | A1 | 11/2007 |

OTHER PUBLICATIONS

French Search Report in French Application No. FR 0851037, dated Nov. 4, 2008.

International Search Report and Written Opinion in International Application No. PCT/EP2009/051863, mailed Sep. 4, 2009.

* cited by examiner

ELECTROSTATIC FILTERING DEVICE USING OPTIMIZED EMISSIVE SITES

CROSS REFERENCE TO RELATED APPLICATIONS OR PRIORITY CLAIM

This application is a national phase of International Application No. PCT/EP2009/051863, entitled, "Device For Electrostatic Filtering Using Optimised Emissive Sites", which was filed on Feb. 17, 2009, and which claims priority of French Patent Application No. 08 51037, filed Feb. 19, 2008.

AREA OF THE INVENTION

The invention concerns the area of industrial installations which generate dust, which may or may not be toxic, such as particles in suspension in a fluid. This is the case with processes for the heat treatment of hazardous materials, such as organic nuclear waste, toxic industrial waste or hazardous raw materials. The invention additionally concerns the area of electrostatic filtering devices whether having plate or tubular structures. It may also concern any gas ionization device.

PRIOR ART AND PROBLEM RAISED

In many of the above-cited installations, there is a need for extremely efficient filtering systems for installations which treat fluids containing particles or dust in suspension. Existing filtering systems are numerous and can be divided into the three following categories: filters using mechanical devices, filters using fluids and filters using physical phenomena. The latter category particularly includes electrostatic filters used in thermal plants and incineration units, of industrial size but also of small size.

The major advantage of this type of equipment is firstly that it does not generate any filter pressure drop in treatment units, and secondly it does not require the use of filtering media often the cause of extra cost and secondary waste, for which it is often necessary to find outlets. For example, regarding the treatment of hazardous waste such as radioactive waste, the production of secondary waste is often responsible for a substantial decrease in the financial profitability of the installation.

The technology of electrostatic filters is based on the electric charge of the particles contained in a gas and which then migrate towards a collecting wall, under the action of an electrostatic field. Ionization is generally conducted using a cathode and collection uses an anode. The distance between the two electrodes ensure the flow of gases without generating any pressure drop. The most frequently used geometries for these electrodes are of <<planar wire>> type, in which the cathodes are characterized by wire structures with axial symmetry, placed between collector plates brought to anodic potentials. The geometries of <<cylindrical wire>> type are less common, even though just as efficient and perhaps easier to maintain. The type of voltage applied to the cathode, and the geometry of this cathode, are two fundamental parameters which govern the functioning and endurance of an electrostatic filter. With respect to the cathodes, the geometries frequently used are tungsten wires or wires of barbed wire type, whose points are randomly distributed and ensure better emissivity of the electrode. The voltages applied are of direct type and are limited to the breakdown voltages in the spaces between the electrodes.

Irrespective of the structures used, the recorded efficacies may be excellent and exceed 99%. However, experience has shown that it is not possible to maintain these levels over time.

FIG. 1 gives the results of an experiment conducted on a filter of tubular type with a diameter of about 300 mm and whose tungsten wire electrode was held at 67 kV. For a little over 5 hours, between points 1 and 4, it can be seen that the associated efficacy decreases progressively falling from 99.6% to 93.6%. Gradual raising of the voltage to 80 kV, which can be seen at points 5 and 6, allows the restoring of efficacy to 99%, but this is only maintained a few minutes before decreasing once again. The voltage level is then at its maximum and starts to generate undue arcing, whose onset generates a drop in efficacy. To maintain efficacy at its optimum levels, operators and users of this type of technology are led to carrying out relatively repetitive cleaning cycles, which are often ensured by mechanical rapping of the structures thereby leading to more or less extensive re-entraining of particles in the gaseous flows.

Yet, it has clearly been demonstrated during experimental studies, that the drop in performance of an electrostatic-type filter is related to changes in discharge phenomena, as and when dust accumulates on the surfaces of the two electrodes, to form layers having more or less insulating properties. Therefore the accumulation of new charges on this layer leads firstly to a reduction in the effect of the electric field between the two electrodes, resulting in a decrease in the migration of charged dust, and secondly to local strengthening of the electric field at the anode deposit, thereby giving rise to discharges of positive polarity. The consequence of these discharges called <<anode counter-emissions>> is an increase in the mean current injected in the filter, whilst reducing its filtering efficacy. Additionally, discharges of positive polarization develop chiefly at the input to the filter which is the first to become fouled. The direct consequence of these phenomena is that the effective portion of said electrostatic filter is limited to a short length compared with a commonly implanted structure.

Figure 2A:
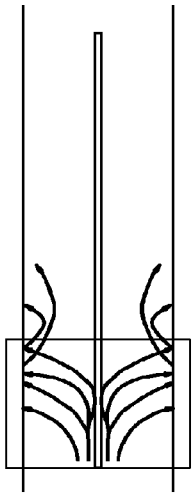
FIG. 2A PRIOR ART
Figure 2B:
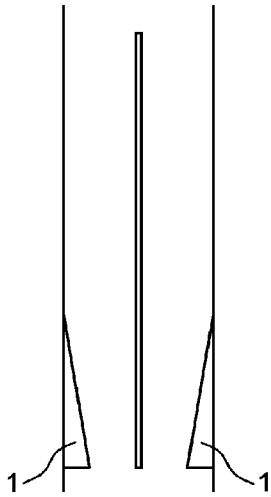
FIG. 2B PRIOR ART
Figure 2C:
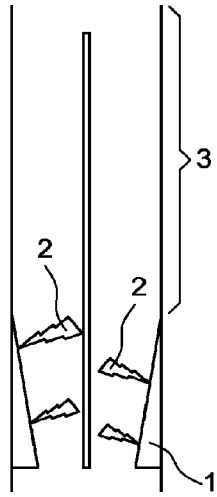
FIG. 2C PRIOR ART

FIGS. 2A, 2B and 2C illustrate this fact. With reference to FIG. 2A, when the filter is clean, the dust is charged at the time of its entry and migrates towards the wall to form a layer on the anode. When the dust is pulled away from the layer, it can possibly migrate again to become trapped a little higher up. Therefore the layer referenced 1 in FIG. 2B, is limited to the lower portion of the filter, with a more diffuse part on the upper portion.

With reference to FIG. 2C, when the layer 1 becomes too thick, arcing phenomena 2 occur in the lower part, which limits the efficacy of the whole and requires stoppage of the system for cleaning. Therefore the portion located above the so-called effective portion, and which we have called the <<safety portion>> 3, allows the collection of any dust which may again be emitted in the gaseous flow. This portion is in fact non-effective and could be limited by optimizing the geometry of the cathode and the driving thereof.

The purpose of the invention is therefore to overcome these disadvantages by proposing other types of electrostatic filter and emissive electrodes. More precisely, the purpose of the invention is to extend the effective portion of the device to the entire length of the electrodes, and secondly to delay arcing which causes drops in efficacy followed by stoppages to clean the device.

SUMMARY OF THE INVENTION

The invention is based on the use of a cathode coupled with a power supply which may be hybrid i.e. direct and/or pulsed. This makes it possible firstly to extend the effective portion to the entire length of the electrostatic filter, and secondly to delay arcing which causes drops in efficacy and stoppages for cleaning. Said cathode is all the more efficient since it is able to charge particles easily in a gaseous flow.

For this purpose, the chief subject-matter of the invention is an electrostatic filtering device having at least one emissive cathode placed in a filtering channel. The cathode has points distributed in staggered fashion over several planes, and offset in angular orientation from one plane to another, the electric voltage having at least one direct component.

According to the invention, the voltage also contains a pulsed component added to the direct component and provided by a generator which ensures very sharp cut-off i.e. a rise time in the order of 150 ns, and the cathode is divided into sectors by a succession of insulated N sectors containing several planes of points.

In a first form of embodiment of the invention, the channel of the device is tubular, notably its collector anode. The cathode is a single cathode and comprises several points per plane, the points being offset at an angle from one plane to another.

In this case, one preferred embodiment makes provision for eight points per plane, offset from each other by 45°, an offset of 22.5° being provided from one plane to another. In this case, it is possible to provide that the number n of planes P is 30 L/D.Lnd, L being the height of the tube, D being its diameter, lnd being the Neperian logarithm of d which is the distance between the tip of the points and the wall of the collector anode.

In a second form of embodiment of the invention, the filtering channel is defined by two plates forming two parallel anodes, several cathodes comprising two points per plane arranged perpendicular to the anodes, parallel to each other, the planes of one cathode being offset relative to the plane of the adjacent cathodes.

In this case, if the height between the planes of one same cathode is h, the planes of the adjacent cathodes are offset by a height h/2 relative to the plane of the cathode under consideration.

In this type of embodiment, the space between two cathodes is equal to about the distance separating them from the two anode plates.

A first manner to provide electric supply consists of placing the entire cathode at a first voltage $U_1$ that is direct and equal to a fraction (for example 70%) of the breakdown voltage $U_C$ and increased by a second direct voltage $U_2$ that is equal to or lower than the breakdown voltage $U_C$, less the first voltage $U_1$. This second voltage $U_2$ is applied to each of the sectors, this voltage being withdrawn as soon as breakdowns appear at the first sector and successively at the following sectors, and optionally until there is no more arcing. In this first case, the first and second voltages $U_1$ and $U_2$ are therefore direct voltages.

The second manner in which to supply the device of the invention is for the first voltage $U_1$ to be equal to a fraction (for example 50%) of the breakdown voltage $U_c$, $U_1$ being direct, and increased by a second determined, pulsed voltage $U_P$, such that the sum of the first voltage $U_1$ and the second voltage $U_P$ is equal to or greater than the breakdown voltage $U_C$. The second determined voltage $U_P$ is withdrawn in each sector as soon as there is an onset of arcing thereat.

LIST OF FIGURES

Figure 3A:
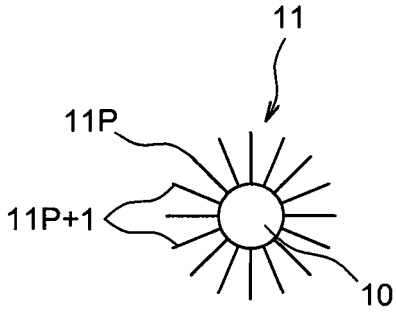
Figure 3B:
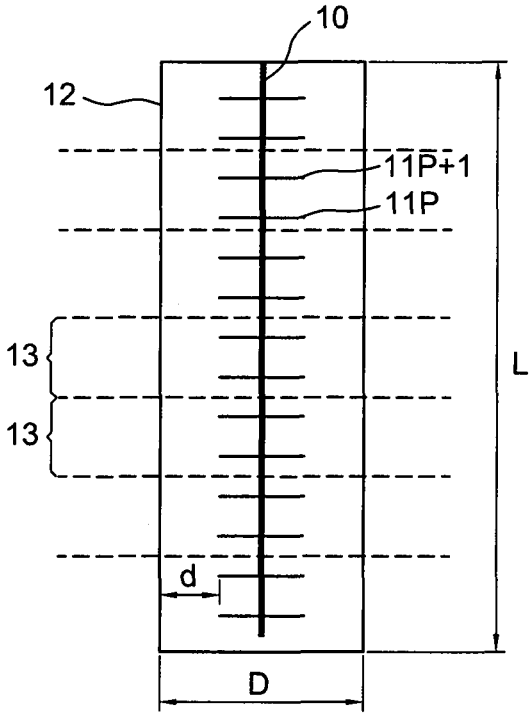
Figure 4B:
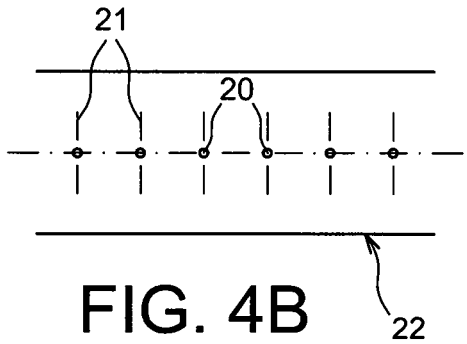
Figure 4A:
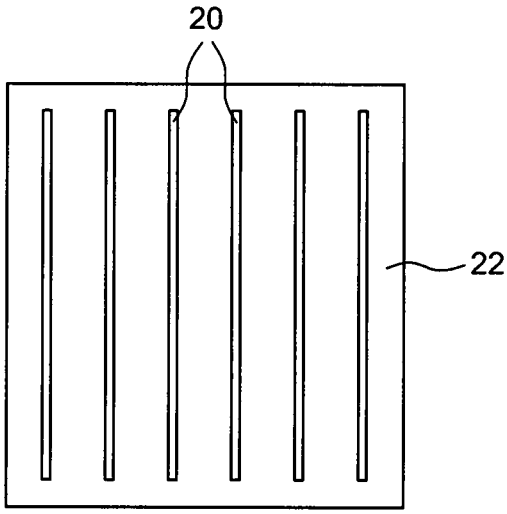
Figure 4C:
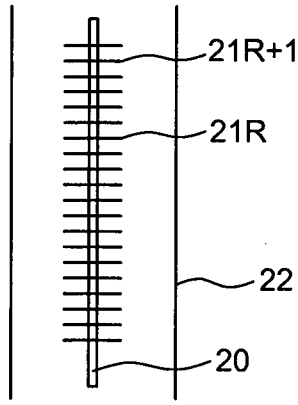
Figure 5:
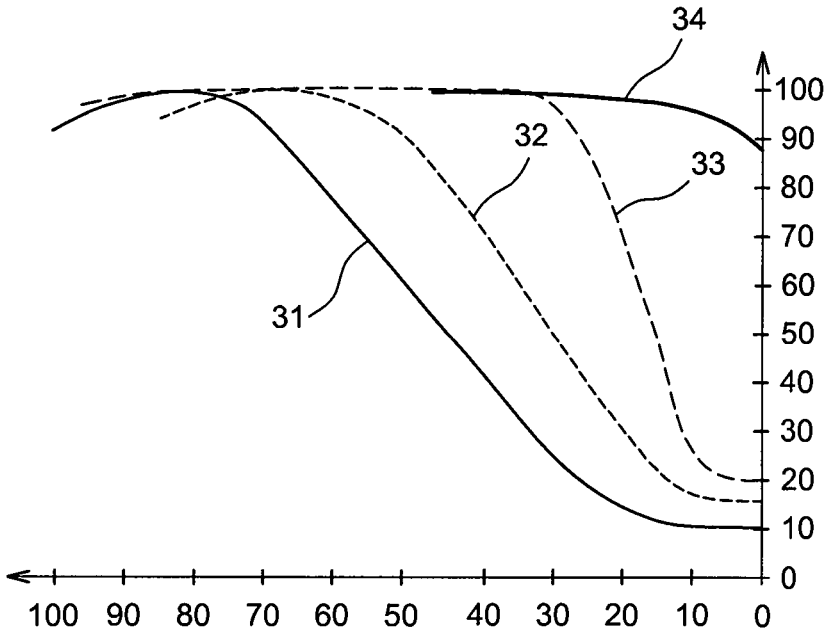
Figure 6:
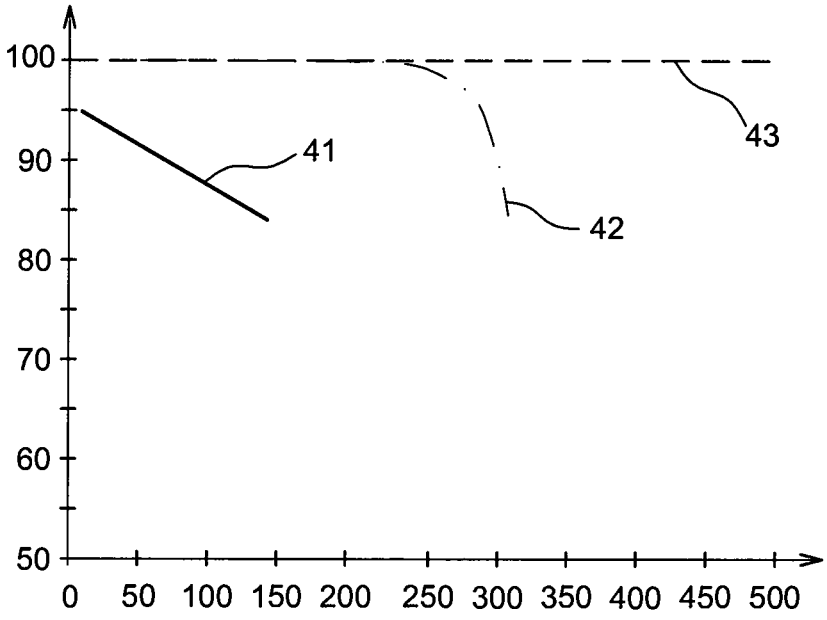

The invention and its different technical characteristics will be better understood on reading the following description accompanied by several figures respectively illustrating:

FIG. 1, already described, the efficacy of some filtering devices in the prior art;

FIGS. 2A, 2B and 2C, already described, schematics showing the phenomena appearing in prior art devices;

FIGS. 3A and 3B, two schematics showing a first embodiment of the device according to the invention;

FIGS. 4A, 4B and 4C, schematics of a second embodiment of the device according to the invention;

FIG. 5, a graph showing the results of tests conducted on the device according to the invention; and FIG. 6, a graph showing the yield of several types of devices according to the invention.

DETAILED DESCRIPTION OF TWO EMBODIMENTS OF THE INVENTION

It was decided to design a cathode capable of charging particles in a gaseous flow in the easiest manner possible.

As shown FIG. 3A, the cathode consists of a central core 10 on which a large number of points 11 have been fixed, which extend radially and perpendicular to the axis of the central core 10. In this FIG. 3A, the points appear offset from each other at an angle of 22.5°. This FIG. 3A is in fact an overhead view and the points, which successively appear to be offset from each other, are those of two different planes, one plane of order P and one plane of order P+1. In fact all the points 11P of the plane of order P are spaced at an angle of 45° from each other, as are all the points 11P. On the other hand, there is an offset of 22.5° between the points 11P of a plane of order P relative to the points 11P+1 of a plane of order P+1.

FIG. 3B shows the same cathode with its central core 10, these different points 11P and 11N+1 are placed inside a cylindrical, hollow anode 12 whose diameter D is greater than twice the length of the points 11P and 11P+1. The tips of these points 11, 11P+1 therefore form emissive sites regularly distributed in space.

In one more concrete embodiment of an average structure, the distance between the two planes P and P+1 may be approximately 40 mm, which allows about 25 planes per metre. It is possible to define the number n of planes P to use in said filtering device of anode height L and diameter D using the following equation:

$$n=30L/D.Lnd,$$

d being the distance between the tip of the points 11P and 11P+1 and the inner wall of the anode 12 which is a collecting anode.

It is specified that the supply to the cathode is divided into N insulated sectors 13, N=L/D.

With reference to FIG. 4A, the second chief embodiment of the filtering device according to the invention consists of using a filter of plate type. In this figure, a main distinction can be made between a plate which is an anode 22, in front of which cathodes 20 are vertically arranged.

FIG. 4B shows an overhead view of this device. Two parallel anodes 22 can be seen each consisting of a plate and between which there is a row of cathodes 20. Each of these cathodes comprises several pairs of points 21, fixed to the core of the cathode 20, radial fashion relative thereto and perpendicular relative to the two anodes 22. Similar to the embodiment shown FIGS. 3A and 3B, the points 21 of the cathodes 20 are distributed over several planes. FIG. 4C illustrates the distribution of these points 21R and 21R+1 over the height H of the whole. It will be noted that for a cathode of row R, the points 21R are positioned in planes separated by a determined height h.

In addition, the cathode R+1 has points 21R+1, which are also positioned in planes distant from the height h, these planes being offset by a distance h/2 relative to the planes of the adjacent cathode of row R.

In substance, for a filter with a cathode height of 10 m, having points of 2 cm, the distance between these points could be 70 mm. This distance varies in relation to the length of the points, which itself also causes a variation in the voltage used in this cathode, notably the breakdown voltage $U_C$. By way of indication, it can be envisaged that the distance between the two collector anodes 22 is 400 mm, the cathodes 20 being positioned mid-way between these two anodes 22 i.e. at 200 mm from each thereof. Evidently, the flow of gas is perpendicular to the cathodes, since it enters laterally into the filter, as indicated by the arrows in FIGS. 4A and 4B. In this case, it is at the first cathodes 20 that maximum filtering occurs. The sectoring of the electric supply to the cathodes can be made in sectors of two or three cathodes.

One major characteristic of the invention consists of providing the filtering device with at least two types of power supply, i.e. a fully direct supply or a supply that is partly direct and partly pulsed. This allows the effective portion to be extended over the entire length of the filtering device and allows the delaying of arcing.

One first case consists of using a first direct voltage $U_1$ whose level is equal to a fraction (for example 70%) of the breakdown voltage $U_C$, at which arcing occurs. A first direct voltage $U_1$ is completed by a second direct voltage $U_2$ defined by the following formula:

$$U_2 \leqq U_C - U_1.$$

A second manner in which to power this electrostatic filtering device according to the invention consists of using a first direct voltage $U_1$ at a level equal to a fraction (for example 50%) of the breakdown voltage $U_C$, increased by a pulsed voltage $U_P$ whose maximum value is defined by the following formula:

$$U_1 + U_P \leqq U_C.$$

In this second case, the pulsed voltage is delivered by a generator which ensures a rise time in the order of 150 ns, i.e. very sharp cut-off with a frequency in the order of one kHz. In the mode of use of the filtering device according to the invention, provision is made to use power supply means which withdraw the second voltage $U_2$ or $U_P$ in the sectors of the cathode(s) as and when electric arcing occurs in these sectors. For this purpose, the cathode(s) are electrically divided into a determined number N of sectors.

When the number of arcs occurring in the first sector of the filtering device becomes too high, for example one arc per second, the supply of the second voltage is stopped in this sector, whereas the first is maintained. This sector is then only supplied by the first voltage $U_1$. Filtering is conducted in this manner in the entire device and continued until the number of arcs in the last sector exceeds the fixed limit. At this point, the structure assembly must be cleaned.

FIG. 5 clearly illustrates the result obtained after several experimental tests on tubular cathodes, such as illustrated FIG. 3. More precisely, the trend in cathode yield can be seen depending on different cathode shape i.e. a tubular cathode (curve 31), a cathode consisting of a threaded rod (curve 32), a cathode according to the invention with direct power supply (curve 33) and a cathode according to the invention with direct and pulsed supply (curve 34). The maximum value of the voltage depends on the distance between the cathode(s) and the anode(s). It is ascertained that when the cathode(s) of the invention are supplied by a direct and a pulsed voltage (curve 34) efficacy is further improved. It is also ascertained that, for a basic voltage level, the pulsed fraction already accounts for close to 90% of efficacy.

FIG. 6 shows the full advantage of cathode+direct voltage and pulsed voltage coupling, for a given structure. It allows much longer operating times than with other electrodes, during experimental periods limited to 8 hours, with no drop in efficacy. The application of said voltage coupling onto a sectored cathode ensures very long endurance. More precisely, this FIG. 6 shows the trend in the yield of the cathodes, as a function of operating time, in relation to the applied geometries and voltages. Curve 41 relates to notched tube cathode geometry, curve 42 relates to a cathode according to the invention supplied with a direct voltage and curve 43 relates to a cathode of the invention supplied with a direct and a pulsed voltage. The value of the breakdown voltage $U_C$ depends on the distance between the anode(s) and the cathode(s).

The invention claimed is:

1. Electrostatic filtering device, equipped with at least one cathode which is emissive, positioned in a filtering channel, having points distributed staggered fashion over several planes P, angularly offset from one plane to another and placed under a first direct voltage ($U_1$), characterized in that a pulsed component $U_{PC}$ is added to the first direct voltage ($U_1$), this pulsed component being delivered by a generator which ensures a very sharp cut-off including a rise time of about 150 ns, and in that the at least one cathode is divided into a determined number N of insulated sectors.

2. Filtering device according to claim 1, characterized in that the filtering channel is tubular, made of a tubular anode, the cathode being a single cathode and having several points per plane, these points being offset at an angle from one plane to another.

3. Filtering device according to claim 2, characterized in that the cathode has eight points per plane, each offset from the other by 45°, the staggering of the points of one plane P relative to the other plane P+1 being 22.5°.

4. Filtering device according to claim 2, characterized in that the number n of planes is equal to 30.N/D/Lgnd, L being the length of the filter, D being the diameter of the anode, d being the distance separating the tip of the points from the inner wall of the anode which is tubular.

5. Device according to claim 1, characterized in that the channel is defined by two plates forming anodes parallel to each other, the device using several cathodes, and comprising two points per plane and arranged perpendicular to the anodes parallel to each other, the planes of one cathode of row R being offset from the plane of an adjacent cathode of row R+1.

6. Filtering device according to claim 5, characterized in that h being the height separating two planes of points of one same cathode, the staggering of the planes between two electrodes of rows R and of rows R+1 is h/2.

7. Filtering device according to claim 6, characterized in that the different cathodes are separated from each other by a distance equal to the distance separating the cathodes from the anodes.

8. Filtering device according to claim 1, characterized in that the N insulated sectors are individually supplied by a first voltage ($U_1$) equal to a fraction of the breakdown voltage ($U_C$), ($U_1$) being direct, and by a second voltage $U_2 \leqq$ the breakdown voltage ($U_C$) less the first voltage ($U_1$), ($U_2$) also being direct on the sectors separately, ($U_2$) being withdrawn as and when arcing occurs in the successive sectors, and in that it has means to stop the second voltage $U_2$ or $U_p$ successively in each of the sectors of the at least one cathode when electric arcing occurs in each of the sectors.

9. Filtering device according to claim 1, characterized in that the at least one cathode is supplied with a first direct voltage ($U_1$) that is equal to a fraction of the breakdown voltage ($U_C$), increased by a pulsed voltage $U_P$ defined by the formula:

$$U_1+U_P>U_C$$

and in that it has means to stop the second voltage $U_2$ or $U_p$ successively in each of the sectors of the at least one cathode when electric arcing occurs in each of the sectors.

10. Filtering device according to claim 8, characterized in that it has means to withdraw the second voltage $U_2$ or $U_P$ successively in each of the sectors of the at least one cathode when electric arcing occurs in each of the sectors.

* * * * *

UNITED STATES PATENT AND TRADEMARK OFFICE

CERTIFICATE OF CORRECTION

PATENT NO. : 8,518,163 B2
APPLICATION NO. : 12/867477
DATED : August 27, 2013
INVENTOR(S) : Lemont et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 475 days.

Signed and Sealed this
Fifteenth Day of September, 2015

Michelle K. Lee

Michelle K. Lee
*Director of the United States Patent and Trademark Office*